United States Patent [19]

Pinck

[11] 4,202,421

[45] May 13, 1980

[54] IMPACT BIT HAVING CIRCUMFERENTIAL INSERTS OF DIFFERING COMBINATION

[75] Inventor: Klaus Pinck, Feucht, Fed. Rep. of Germany

[73] Assignee: Fried. Krupp Gesellschaft mit beschränkter Haftung, Essen, Fed. Rep. of Germany

[21] Appl. No.: 952,052

[22] Filed: Oct. 17, 1978

[30] Foreign Application Priority Data

Nov. 5, 1977 [DE] Fed. Rep. of Germany ..... 2749613

[51] Int. Cl.[2] ..... E21C 13/06

[52] U.S. Cl. ..... 175/410; 175/374; 175/393; 175/415

[58] Field of Search ..... 175/374, 376, 398, 410, 175/414, 415, 417, 418

[56] References Cited

U.S. PATENT DOCUMENTS

| | | | |
|---|---|---|---|
| 3,357,507 | 12/1967 | Stewart | 175/418 X |
| 3,385,385 | 5/1968 | Kucera et al. | 175/374 |
| 3,583,504 | 6/1971 | Aallind | 175/410 X |
| 3,726,350 | 4/1973 | Pessier | 175/376 X |
| 4,106,578 | 8/1978 | Beyer | 175/410 X |

*Primary Examiner*—Ernest R. Purser
*Assistant Examiner*—Nick A. Nichols, Jr.
*Attorney, Agent, or Firm*—Spencer & Kaye

[57] ABSTRACT

A hammer drill bit has an axis, a shaft and a crown and a plurality of hard metal circumferential studs carried by the crown and distributed along a circumference thereof. Each circumferential stud has an axis inclined at an acute angle with respect to the bit axis and a conical cutting tip oriented obliquely away from the bit axis. The acute angles of the axes of consecutively viewed circumferential studs alternate between a relatively large magnitude and a relatively small magnitude differing by 10° to 25° from one another.

3 Claims, 4 Drawing Figures

IMPACT BIT HAVING CIRCUMFERENTIAL INSERTS OF DIFFERING COMBINATION

BACKGROUND OF THE INVENTION

This invention relates to a hammer drill bit for rock formations and is of the type that has a shaft which is connectable with a hammer drill or a drill rod and has a crown provided with hard metal studs each having a conical cutting tip. At least some of the studs are circumferential studs distributed along the crown circumference. These circumferential studs are all oriented, with their conical cutting tip, forwardly and away from the tool bit axis and their axis forms an acute angle with the tool bit axis.

Hammer drill bits of the above-outlined type are known in which the axes of all hard metal studs arranged on the crown circumference from an angle of 45°, 30° or 37° with the bit axis. In these known tool bits the axes of the other hard metal studs arranged on the crown are parallel to the tool bit axis and further, the conical cutting tip of the hard metal studs has an opening angle of 75° to 90°. In the known hammer drill bits, the hard metal studs are brazed or press-fitted into bores provided on the drill bit crown.

Hammer drill bits in which the axis of each hard metal stud arranged at the crown circumference forms an angle of 45° with the tool bit axis wear rapidly, since the obliquely inserted hard metal studs break prematurely in view of the fact that the base of the borehole and one part of the lateral surface of the conical cutting tip of the hard metal studs are in a large measure parallel to one another, so that a substantial pressing force is exerted on these studs by the borehole base.

Also, the durability of the tool bits in which the axis of each hard metal stud arranged at the crown circumference forms an angle of 30° with the tool bit axis is unsatisfactory, since the wall of the borehole and on part of the surface of the conical cutting tip of the hard metal studs inserted at an angle of 30° extend essentially parallel to one another, so that the wall of the borehole exerts such a great pressure on the hard metal studs that the drill bit tends to jam in the borehole and the obliquely inserted hard metal studs are likely to break.

A certain improvement in the durability of the known hammer drill bits could be achieved by providing that the axis of each hard metal stud arranged at the crown circumference forms an angle of 37° with the tool bit axis. Even in such an arrangement, however, the hard metal studs were found to break much too rapidly.

For avoiding a premature wear of the known hammer drill bit it has further been proposed to grind a clearance angle of approximately 3° on the hard metal studs arranged at the crown circumference. Although, as a result, the hammer drill could operate without large pressure exerted thereon by the borehole wall, it is a disadvantage of this solution that with the above-noted grinding operation, a part of the crown material is necessarily removed. This enhances a breakage of the hard metal studs from their socket.

SUMMARY OF THE INVENTION

It is an object of the invention to provide an improved hammer drill bit which, compared to known bits, has a better wear resistance and wherein particularly those hard metal studs which are arranged at the crown circumference do not break as rapidly as in known tool bits.

This object and others to become apparent as the specification progresses, are accomplished by the invention, according to which, briefly stated, the hammer drill bit has an axis, a shaft, a crown and a plurality of hard metal circumferential studs carried by the crown and distributed along a circumference thereof. Each circumferential stud has an axis inclined at an acute angle with respect to the bit axis and a conical cutting tip oriented obliquely away from the bit axis. The acute angles of the axes of consecutively viewed circumferential studs alternate between a relatively large magnitude and a relatively small magnitude differing by 10° to 25° from one another.

The above-defined arrangement according to the invention means that the hard metal studs at the circumference of the crown (that is, the circumferential studs) form, as viewed from stud to stud, in an alternating manner, a greater and a smaller acute angle with the tool bit axis. The difference between the larger and the smaller angle is from 10° to 25°. The tool bit according to the invention was found to have particularly advantageous properties in case the axes of the hard metal circumferential studs form with the tool bit axis an angle of from 50° to 25°. A hammer drill bit wherein the axes of the hard metal circumferential studs arranged on the crown circumference form alternatingly an angle of 45° and 30° has been found to be particularly advantageous. It is noted that only the conical cutting tip of the circumferential hard metal studs project from the crown surface.

In using the hammer drill bit structured according to the invention, it has been unexpectedly found that the hard metal studs arranged at the crown circumference are, because of their non-uniform orientation to the tool bit axis, substantially relieved of pressures generated at the base and the wall of the borehole. The non-uniform orientation of the circumferential hard metal studs results in two very closely positioned cutting paths and further, the hard metal studs mutually assist one another in freeing themselves during operation.

DESCRIPTION OF THE PREFERRED EMBODIMENT

Figure 1:
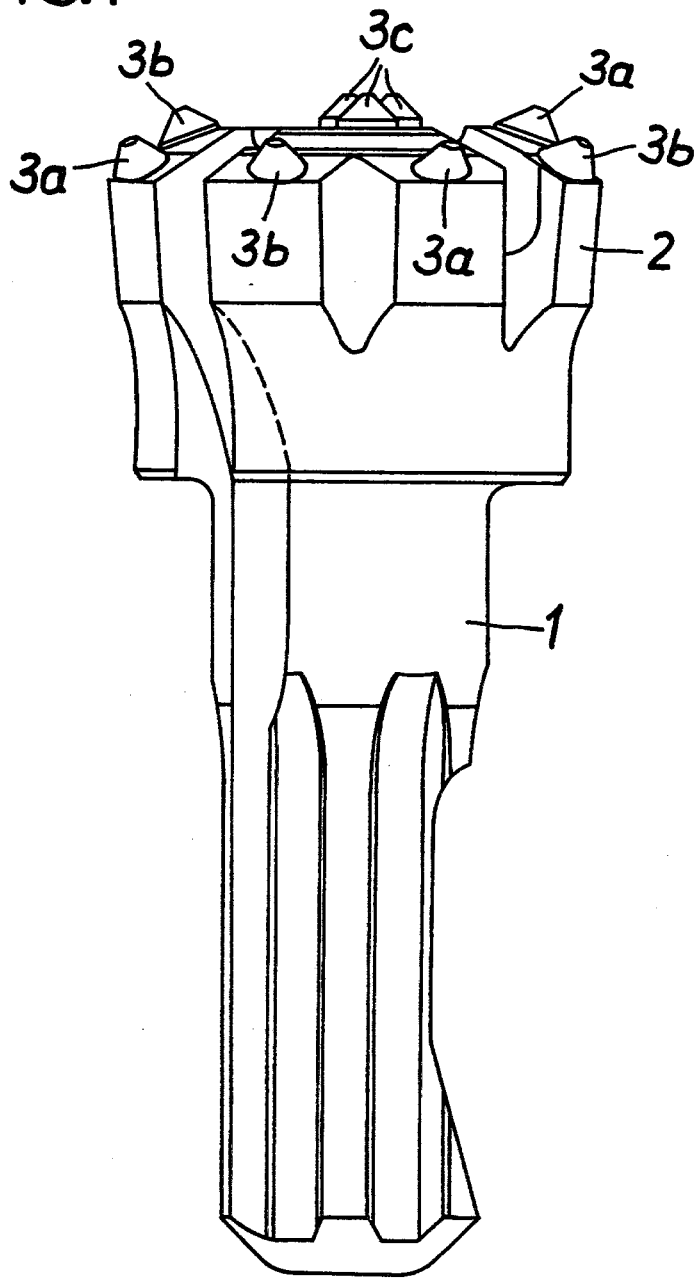
FIG. 1 is an elevational view of a preferred embodiment of the invention.
Figure 2:
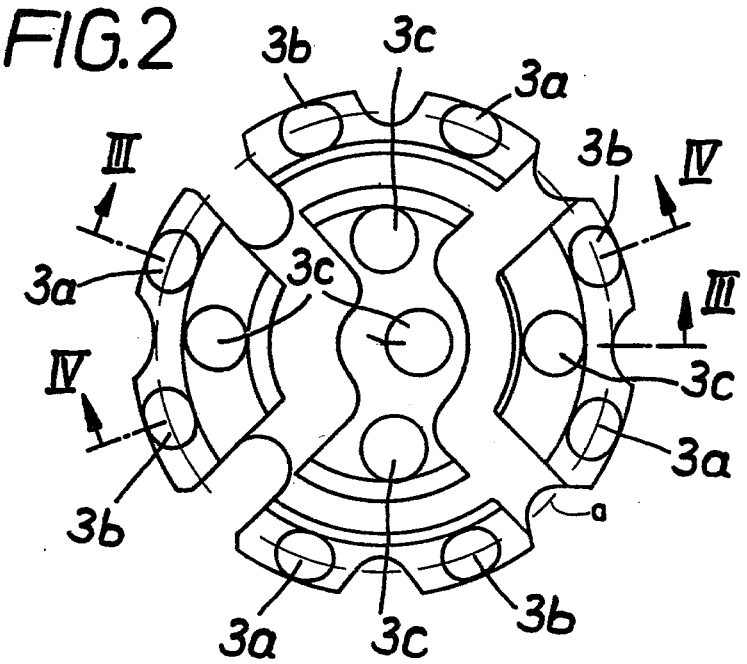
FIG. 2 is a top plan view of the same embodiment.

Turning now to FIGS. 1 and 2, the hammer drill bit shown therein comprises a shaft 1 and a crown 2. The shaft 1 is attached to a hammer (percussion) drill or a drill rod and may be provided with a thread or may have another configuration adapted for insertion. The shaft 1 and the crown 2 are steel which, for example, may have the composition of 14 Ni Cr 18.

Along the circumference (outer periphery) of the crown 2, circumferential hard metal studs 3*a* and 3*b* are arranged, while inwardly of the crown circumference, hard metal studs 3*c* project from the crown surface. The hard metal studs 3*a*, 3*b* and 3*c* may be, for example, 91% WC and 9% Co. As well seen in FIG. 2, the circumferential studs 3*a* and 3*b* are distributed on a sole imaginary circle a. The hard metal studs 3a, 3b and 3c are press-fitted or brazed into bores provided in the crown 2. They further have the shape of a cylinder terminating at each end by a cone. While one conical portion and the cylindrical part of each hard metal stud is entirely within the body of the crown 2, the other conical end formed as a cutting tip 4 projects from the surface of the crown 2.

Figure 3:
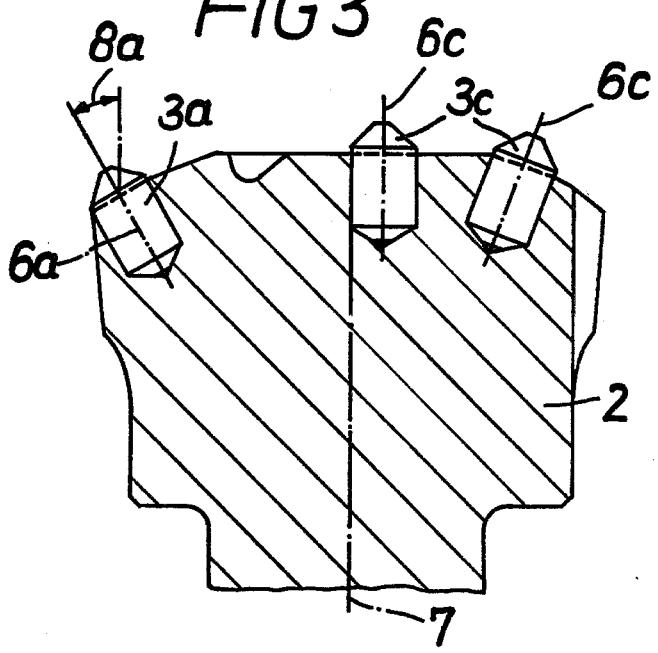
FIG. 3 is a sectional view taken along lines III—III of FIG. 2.
Figure 4:
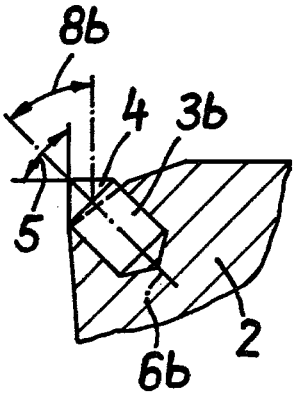
FIG. 4 is a fragmentary sectional view taken along lines IV—IV of FIG. 2.

Also referring now to FIGS. 3 and 4, the opening angle 5 of each cutting tip 4 is between 75° and 90°. The axes 6c of the hard metal studs 3c may be either parallel to the tool bit axis 7 or may form therewith an acute angle. In case the crown 2 has large dimensions, both alternatives may be present, as illustrated in FIG. 3. Those hard metal studs 3c which are at an acute angle with respect to the tool bit axis 7 are oriented towards the circumference of the crown 2.

The circumferential hard metal studs 3a and 3b arranged along the circumference of the crown 2 are arranged in such a manner that their respective axes 6a and 6b form an acute angle with the tool bit axis 7 and the cutting tips 4 are oriented towards the crown circumference. According to the invention, the acute angles of the successive hard metal circumferential studs 3a and 3b alternate in magnitude and differ from one another by 10° to 25°. Further, according to the invention, the acute angles which the axes 6a and 6b form with the tool bit axis 7 are between 50° and 25°. Thus, in the hammer drill bit illustrated, the acute angle 8a is 30° and the acute angle 8b is 45°.

The service life of a hammer drill bit structured according to the invention as described above and used for drilling granite was found to have a 30% increased service life as compared to hammer drill bits utilized under the same operational conditions and having, at the crown circumference, hard metal studs which all have the same acute angle with respect to the tool bit axis.

It is to be understood that the above description of the present invention is susceptible to various modifications, changes and adaptations, and the same are intended to be comprehended within the meaning and range of equivalents of the appended claims.

What is claimed is:

1. A hammer drill bit including an axis, a shaft and a crown having an outer periphery; a plurality of hard metal circumferential studs carried by the crown and distributed along said periphery essentially on a single circle; each circumferential stud having an axis inclined at an acute angle with respect to the bit axis and a conical cutting tip oriented obliquely away from the bit axis; the improvement wherein the acute angles of the axes of said circumferential studs viewed consecutively along said circle alternate between a relatively large magnitude and a relatively small magnitude differing by 10° to 25° from one another.

2. A hammer drill bit as defined in claim 1, wherein each said acute angle has a magnitude of between 50° and 25°.

3. A hammer drill bit as defined in claim 2, wherein the relatively large magnitude is 45° and the relatively small magnitude is 30°.

* * * * *